US005740831A

United States Patent [19]

DeNardo et al.

[11] Patent Number: 5,740,831

[45] Date of Patent: Apr. 21, 1998

[54] FROSTPROOF HYDRANT SEAL

[75] Inventors: Patrick E. DeNardo, Goshen; Mark A. Clark, Elkhart, both of Ind.

[73] Assignee: Nibco Inc., Elkhart, Ind.

[21] Appl. No.: 777,845

[22] Filed: Dec. 31, 1996

[51] Int. Cl.[6] ..... E03C 1/10

[52] U.S. Cl. ..... 137/218; 137/360; 137/614.2

[58] Field of Search ..... 137/218, 360, 137/614.2

[56] References Cited

U.S. PATENT DOCUMENTS

| | | | |
|---|---|---|---|
| 628,023 | 7/1899 | Neumeyer | 137/302 |
| 1,501,799 | 7/1924 | Neumeyer | 137/302 |
| 2,395,906 | 3/1946 | Owens | 137/218 |
| 2,927,598 | 3/1960 | Thompson | 137/218 |
| 3,106,935 | 10/1963 | Gatzke | 137/218 |
| 3,122,156 | 2/1964 | Kersh | 137/218 |
| 3,158,170 | 11/1964 | Tubbs | 137/218 |
| 3,208,715 | 9/1965 | Noland | 251/12 |
| 3,244,192 | 4/1966 | Noland | 137/302 |
| 3,285,273 | 11/1966 | Noland | 137/272 |
| 3,392,745 | 7/1968 | Noland | 137/301 |
| 3,416,556 | 12/1968 | Nelson | 137/218 |
| 3,424,188 | 1/1969 | Whitaker et al. | 137/218 |
| 3,424,189 | 1/1969 | Woodford | 137/218 |
| 3,454,032 | 7/1969 | Hinz et al. | 137/218 |
| 3,480,027 | 11/1969 | Noland . | |
| 3,504,694 | 4/1970 | Noland | 137/303 |
| 3,534,762 | 10/1970 | Noland | 137/209 |
| 3,565,097 | 2/1971 | Costa et al. | 137/218 |
| 3,566,905 | 3/1971 | Noland | 137/209 |
| 3,581,761 | 6/1971 | Noland | 137/209 |
| 3,632,082 | 1/1972 | Noland | 251/214 |
| 3,929,150 | 12/1975 | Flinner et al. . | |
| 3,952,770 | 4/1976 | Botnick | 137/360 |
| 4,178,956 | 12/1979 | Fillman | 137/360 |
| 4,182,356 | 1/1980 | Woodford | 137/59 |
| 4,206,777 | 6/1980 | Hirsch et al. | 137/218 |
| 4,209,033 | 6/1980 | Hirsch et al. | 137/218 |
| 4,221,233 | 9/1980 | Botnick | 137/218 |
| 4,316,481 | 2/1982 | Fillman | 137/302 |
| 4,475,570 | 10/1984 | Pike et al. | 137/218 |
| 4,532,954 | 8/1985 | Fillman | 137/302 |
| 4,582,081 | 4/1986 | Fillman | 137/218 |
| 4,653,521 | 3/1987 | Fillman | 137/1 |
| 4,653,522 | 3/1987 | Fillman et al. | 137/1 |
| 4,821,762 | 4/1989 | Breneman | 137/454 |
| 4,909,270 | 3/1990 | Enterante et al. | 137/107 |
| 5,012,833 | 5/1991 | Hunley et al. | 137/15 |
| 5,029,603 | 7/1991 | Ackroyd | 137/218 |
| 5,158,105 | 10/1992 | Conway | 137/296 |
| 5,246,028 | 9/1993 | Vandepas | 137/282 |
| 5,392,805 | 2/1995 | Chrysler | 137/218 |
| 5,590,679 | 1/1997 | Almasy et al. | 137/218 |
| 5,632,303 | 5/1997 | Almasy et al. | 137/48 |

FOREIGN PATENT DOCUMENTS 2110015 1/1995 Canada .

*Primary Examiner*—Gerald A. Michalsky

*Attorney, Agent, or Firm*—Price, Heneveld, Cooper, DeWitt and Litton

[57] ABSTRACT

A sillcock which has freeze resistance, backflow contamination resistance and back pressure release from the downstream water, having a resilient, radially compressible and expandable back pressure seal valve which is also axially movable a controlled amount to thereby cover or uncover an inner vent hole between the water passage and a vent passage, to allow pressure release from the water flow passage to the atmosphere.

14 Claims, 3 Drawing Sheets

FROSTPROOF HYDRANT SEAL

BACKGROUND OF THE INVENTION

This invention relates to water valves, at times known as sillcocks, and at times known as water hydrants, and more particularly relates to sillcocks normally intended to be mounted at the exterior of a wall of a building, and having freeze resistant characteristics, anti-backflow contamination resistant characteristics, vacuum breaking characteristics, and downstream pressure venting.

A variety of sillcocks having both freeze resistant and contamination resistant characteristics have been proposed heretofore. The freeze resistant characteristic results from the shutoff valve being actuated by an exterior control handle with the valve located a significant distance inwardly from the handle to be well within the protective confines of the building. Efforts to achieve contamination resistance typically involve a check valve which opens to allow water outflow but closes against water inflow. Thus, resistance to backflow of water under back pressure as from an external water hose back into the system, for example, is provided. This is desirable to eliminate contamination of the potable water supply to satisfy requirements such as ASSE 1019 which has been widely adopted by many communities. Contamination can occur if back pressure allows reverse flow of water back through the water outlet to contaminate the internal potable water supply in a building.

Unfortunately, the known sillcocks or hydrants achieving freeze resistant and anti-backflow contamination features are complex in structure and costly to fabricate. Immediate backflow resistant character can be provided using a resilient, radially compressible-expandable check valve such as that set forth in U.S. Pat. Nos. 3,122,156 and 4,209,033. This latter patent also incorporates a vacuum breaking or release vent system for the space between the main shutoff valve and the water outlet, for release of a potential vacuum which could be created in that zone to cause back siphonage as from a hose.

SUMMARY OF THE INVENTION

An object of this invention is to provide a novel sillcock which has freeze resistance, backflow contamination resistance, vacuum breaking, and back pressure release from the downstream water, and which accomplishes all of these desirable characteristics with a simple, relatively inexpensive structure and combination. The novel sillcock achieves backflow resistance and vacuum breaking with a resilient, radially compressible and expandable back pressure seal valve which is also axially movable a controlled amount along the axis of either the main water valve or of the hollow tubular stem that connects the external control handle to the interior main water valve. The axial movement thereby radially covers or uncovers an inner vent hole between the water passage and a vent passage through the hollow stem, to allow pressure release through the inner vent hole, through the vent passage, to an added outer vent hole communicating with the atmosphere. Thus, when the pressure in the water flow passage communicating with the water outlet is greater than the main water pressure upstream of the back pressure seal valve, the seal valve will not only be radially expanded to close off against reverse flow, but will also shift axially inwardly to uncover the inner vent hole and thereby allow the pressure to be vented and released through the hollow stem to the outer vent hole and hence to the atmosphere.

The resilient seal has an annular lip around the largest diameter portion of the seal, to sealingly engage the inner periphery of the water tube. It also has a pair of axially spaced, inner periphery seal lips around the smallest diameter portion of the resilient seal member, to sealingly engage the outer periphery of the main water valve or alternatively the tubular stem, astraddle the inner vent hole in the normal sealing position, closing off the inner vent hole. Yet, when axially shifted under the pressure differential which may be encountered, the inner seal valve axially shifts to expose the inner vent hole and allow the pressure release.

These and other objects, advantages and features of the invention will become apparent upon studying the following specification in conjunction with the drawings.

DESCRIPTION OF THE PREFERRED EMBODIMENT

Figure 1:
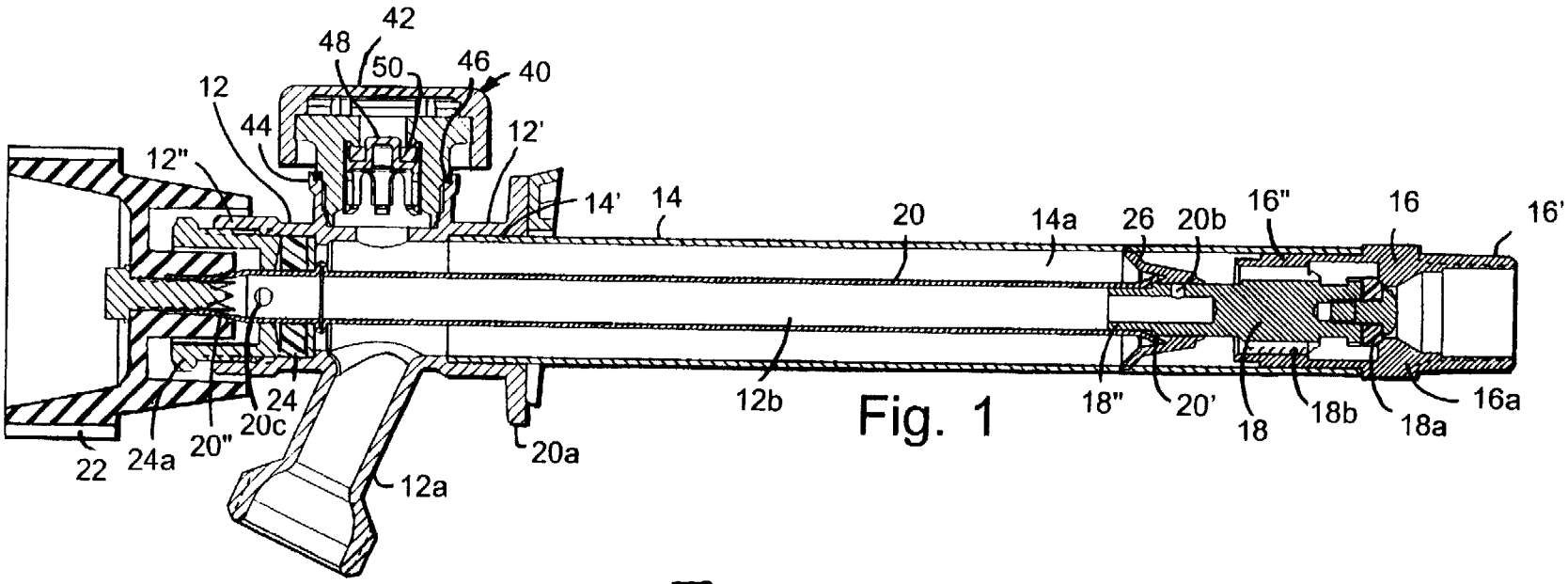
FIG. 1 is a sectional elevational view of the first embodiment of the novel sillcock assembly taken on plane I—I of FIG. 6.
Figure 3:
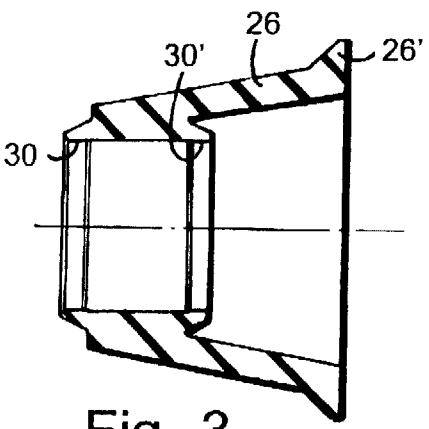
FIG. 3 is a sectional view taken on plane III—III of FIG. 2.
Figure 2:
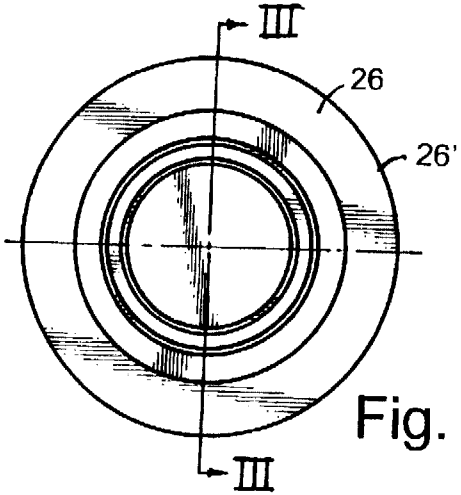
FIG. 2 is an end elevational view of one form of back pressure seal valve for the combination in FIG. 1.
Figure 4:
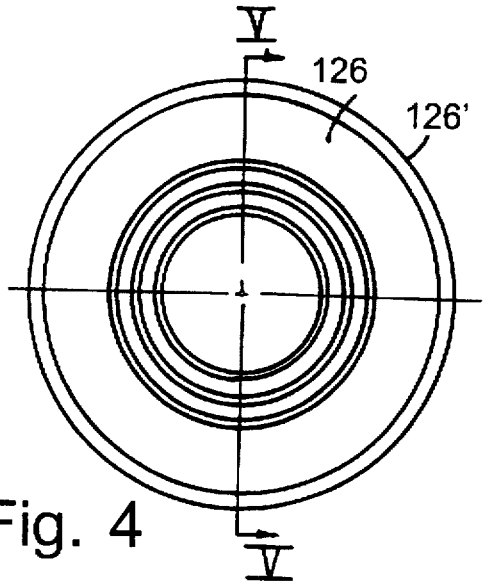
FIG. 4 is an end elevational view of a second form of back pressure seal valve for the combination in FIG. 1.
Figure 5:
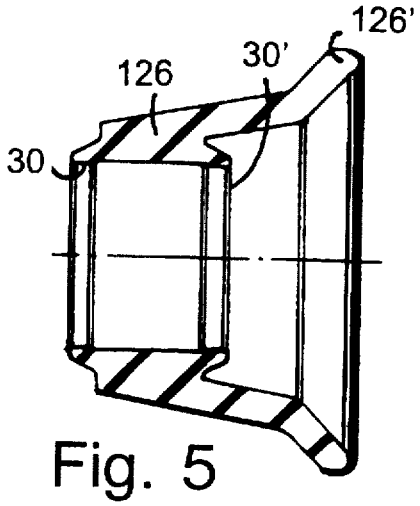
FIG. 5 is a sectional view taken on plane V—V of FIG. 4.
Figure 6:
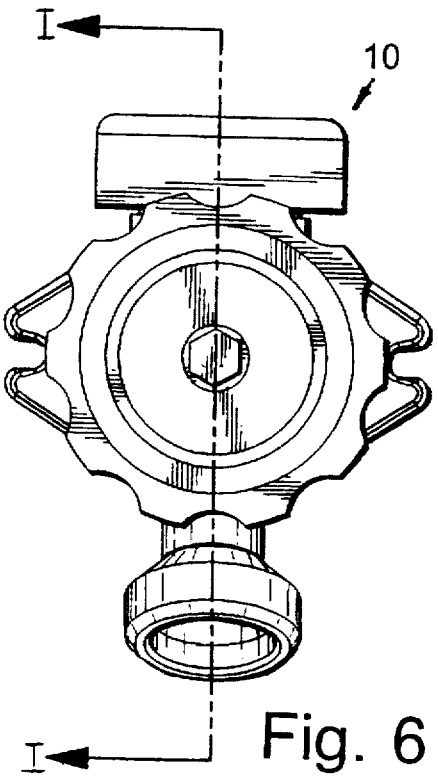
FIG. 6 is an end elevational view of the sillcock assembly.

Referring now to the drawings, the water sillcock assembly 10 comprises a hydrant body 12 having an inner end 12' and an outer end 12", as well as a threaded water outlet spout **12*a* of conventional type. Connected to inner end 12' of sillcock body 12 is a water tube 14 which is elongated so as to extend through a wall and inside a building structure (not shown) against which flange 12*b* of body 12 abuts in conventional fashion. Although water tube 14 may be an initially integral part of a one piece body, preferably it is attached to it as by soldering to the socket on the inner end of body 12** as shown.

At the inner end 14' of tube 14 is what is known as an adapter end 16 which has its downstream end 16" connected to the inner end 14' of tube 14, and having its upstream end 16' adapted to receive a water pipe (not shown) from a water supply source for inflow of water to adapter end 16. At the discharge end 16" of adapter end 16 is a conventional main water valve 18 which may be rotated to open or close the water flow line in conventional fashion. Valve 18 has a seal disc **18*a* to seal against adapter end valve seat 16*a*. Valve 18 has outer peripheral threads 18*b* engaging inner peripheral threads in adapter end 16. To rotationally operate water valve 18 to open or close it, an elongated actuator stem 20 is provided. The inner end 20' of stem 20 is flared and receives downstream end 18" of water valve 18 to which it is affixed as by soldering. Connected to the outer end 20" of actuator stem 20 is a conventional actuator handle 22. Actuator stem 20 is hollow, forming a hollow vent tube with an internal vent passage 20*a*. An inner vent hole 20*b* through the wall of the hollow cylindrical downstream end 18" of water valve 18 allows fluid flow communication between the annular water flow passage 14*a* between tubes 14 and 20, and passage 20***a*. Tube 20 also includes an outer vent hole 20*c* through the wall of the tube, between inner vent passage 20*a* and the ambient atmosphere adjacent handle 22. Specifically, this outer vent hole 20*c* is axially between handle 22 and packing seal 24 that seals off the end of the water tube between the outer periphery of vent tube 20 and the inner periphery of body 12 downstream of water outlet 12*a*. This packing seal may include a conventional packing nut 24*a* threaded to the interior of outer end 12" of body 12.

Referring now specifically to the inner end of hollow actuator stem and vent tube element 20, there is a back pressure seal valve 26 around the periphery of the cylindrical end 18" of valve 18. This seal valve is of generally frustoconical configuration, having its larger diameter portion downstream and its smaller diameter portion upstream. This seal is of elastomeric material such as rubber or the equivalent, being flexible to be radially compressed and expanded under the action of water flow and pressure, and its inherent resilience and memory. The inner diameter and periphery are basically the same as or slightly smaller than that of the outer periphery of valve end 18". The outer diameter and periphery of seal valve 26, when expanded, abut against the inner periphery of water tube 14. When water flows from the adapter end past the flow control valve 18 toward outlet 12*a*, seal valve 26 is resiliently radially compressed to allow water to flow past its outer periphery. However, when water flow is terminated and especially if back pressure is applied to this seal valve, it is again expanded radially into sealing contact at its outer periphery with the interior periphery of outer tube 14 to serve as a check valve against reverse flow.

Figure 7:
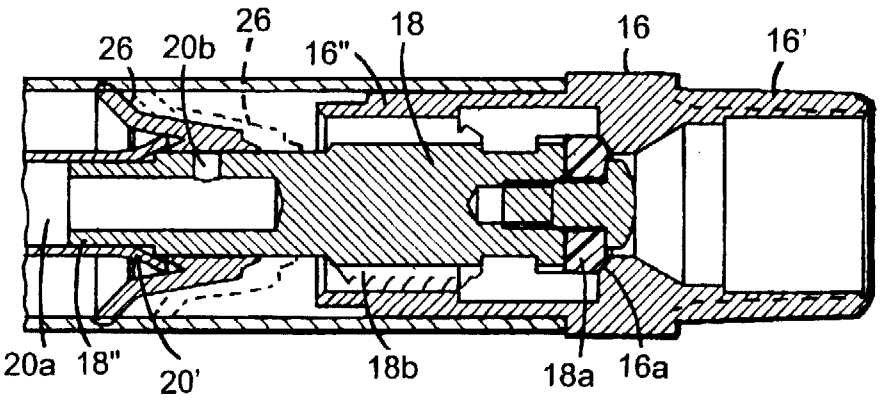
FIG. 7 is an enlarged sectional view of a portion of the assembly in FIG. 1.

This seal valve also has another unique feature using the combination vent tube and vent holes. More specifically, it can move axially along the valve end 18" a controlled amount between the two positions depicted in solid lines and in dashed lines in FIG. 7. Thus, under the pressure of outward water flow, not only will this seal valve be radially compressed, but it also will move axially outwardly to the solid line position in FIG. 7 where the inner periphery collar abuts against an outer axial stop which is preferably the flared inner end 20' of tube 20. In this position, the inner diameter ring of the seal valve covers vent hole 20*b* and seals this vent hole. This sealing action preferably occurs because of a pair of peripheral sealing lips 30 and 30' (FIG. 3) axially spaced from each other on the smallest diameter portion, i.e., inner periphery, of seal valve 26, so as to straddle vent hole 20*b* in this position. Therefore, during water outflow, no fluid passes through vent hole 20*b*. Two alternative configurations of the seal valve are depicted in FIGS. 2 and 3, and FIGS. 4 and 5, respectively. The second configuration seal valve 126 also preferably includes the pair of axially spaced inner periphery sealing lips 30 and 30', but the two have a somewhat different configuration on the outer sealing lip 26' and 126' respectively.

The axially inward position of seal valve 26 is limited by the outer end of threads 18*b* of water valve 18, which threads form the axial inner stop. In this axial inner position, vent hole 20*b* is uncovered and exposed to the water passage 14*a* downstream, i.e., outwardly, of seal valve 26, and to the vent passage 20*a* in the vent tube/water valve stem. Movement to this position is caused by water back pressure so as to not only radially expand seal valve 26 against rearward, i.e., inward, flow of water into the system, but to also allow back pressure release with venting of fluid from the water tube chamber 14*a* between the seal valve 26 and the packing seal 24. That is, sufficient fluid can flow through inner vent hole 20*b*, vent passage 20*a*, and outer vent hole 20*c* to the atmosphere, to relieve this area of the water tube of greater than atmospheric pressure. This is advantageous to, among other things, assure against reverse flow of potentially contaminated water back into the water system within the building. Back pressure can be caused, for example, by water in a hose (not shown) attached to the water outlet 12*a* in conventional fashion.

In operation, therefore, when handle 22 is actuated to rotate it and rotate stem 20 and thereby main water valve 18 which moves on actuator end threads 18*b* to open the valve, water flows outwardly in the direction indicated by the arrow, past main valve 18, thereby shifting seal valve 26 to its outer position against outer stop 20' to thereby close off vent hole 20*b*. The water radially compresses seal valve 26 to flow past its outer periphery to outlet 12*a*. When the water is subsequently shut off by rotating handle 22 in the opposite direction, to rotate tubular stem 20 and water valve 18, if there is residual back pressure in the water pipe downstream from the seal valve, this will cause two different types of movement of the seal valve, one being radial expansion of the seal valve to cause its outer lip, e.g., 26', to sealingly engage the inner periphery of water tube 14, and the second being to shift it axially to uncover vent hole 20*b* and thereby allow back pressure release of this section of water tube so that a continued back pressure is not applied to the seal. If there is a negative pressure, i.e., vacuum, in this space between seal valve 26 and packing seal 24, the conventional vacuum breaker 40 will allow atmospheric air input, to thereby release or break the vacuum. This vacuum breaker 40 comprises a cap 42 on body 44. Body 44 is threadably attached to the top of sillcock body 12, sealed by an O-ring 56. Inside body 44 is a passageway containing a valve 48 with an annular seal gasket 50 to close against an annular shoulder in the body passageway. This valve is normally closed but can open with an inward pressure differential between atmospheric and water passage 14*a* to break the vacuum.

Figure 8:
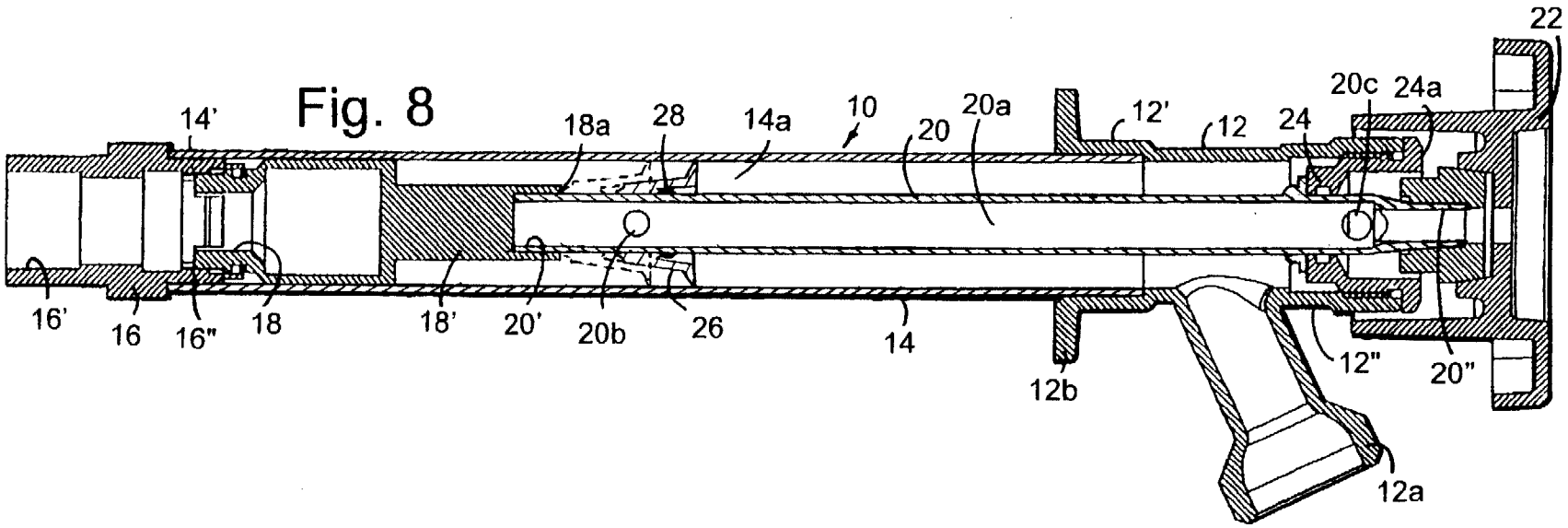
FIG. 8 is a sectional elevational view of the second embodiment of the novel sillcock.

In the first embodiment described above, seal valve 26 is located on the hollow extended end 18" of water valve 18, with hollow tubular vent stem 20 integrally extending from end 18", and with vent hole 20*b* being through end 18". In a second alternative embodiment depicted in FIG. 8, seal valve 26 is positioned on tube 20 which has vent hole 20*b* through its wall. The other components of the assembly are like and have like numerals as in the first embodiment, except that the axial inner and outer stops for the seal valve are slightly different. Specifically, the axial outer stop 28 is a protrusion on tube 20, and the axial inner stop is the end 18*a* of water valve 18. A conventional vacuum breaker 40 as in FIG. 1 could and normally would be positioned on the top of body 12 as in FIG. 1.

Conceivably the various components of this assembly may be modified somewhat to suit a particular type of installation, but without departure from the concept presented. Therefore, it is intended that the invention is not to be limited to the preferred illustrative embodiments set forth, but only by the scope of the appended claims and the reasonably equivalent structures to those defined therein.

The embodiments of the invention in which an exclusive property or privilege is claimed are defined as follows:

1. A water sillcock comprising:

a hydrant body and a water tube forming a water flow passage, and a water outlet from said passage;

a main water valve for said passage;

a control handle;

an actuator stem extending from said control handle through said passage to said main water valve, and comprising a hollow vent tube forming a vent passage;

an inner vent hole from said water flow passage into said vent passage, and an outer vent hole from said vent passage to the ambient atmosphere;

a resilient, radially compressible and expandable back pressure seal valve separate from said main water valve, and located between said vent tube and said water tube to radially compress under forward water flow pressure for water flow through said water flow passage, and positioned and shaped to radially expand against said water tube to prevent backward water flow in said water flow passage; and said seal valve being axially movable relative to said hollow vent tube a controlled amount between a vent hole-covering position to cover said inner vent hole during forward water flow pressure, and a vent hole-uncovering position to uncover said inner vent hole during back flow pressure and thereby vent said water flow passage of said back pressure to the ambient atmosphere.

2. The water sillcock in claim 1 including axial stops positioned to be respectively abutted by said seal valve in said vent hole covering position and in said vent hole uncovering position.

3. The water sillcock in claim 2 wherein one of said stops is formed by said vent tube.

4. The water sillcock in claim 1 wherein said back pressure seal valve is frustoconical in configuration.

5. The water sillcock in claim 4 wherein said back pressure seal valve has an annular sealing lip around its largest diameter portion to seal against said water tube when radially expanded.

6. The water sillcock in claim 4 wherein said back pressure seal valve has sealing lips around its smallest diameter portion to seal against said vent tube.

7. The water sillcock in claim 1 wherein said main water valve has a hollow end attached to said hollow vent tube, said seal valve being mounted on and movable axially on said water valve hollow end, and said inner vent hole extending through said water valve hollow end.

8. The water sillcock in claim 1 wherein said seal valve is mounted on and axially movable on said hollow vent tube, and said inner vent hole extends through said vent tube.

9. The water sillcock in claim 1 including a vacuum breaker on said hydrant body.

10. A water sillcock comprising:

a hydrant body and a water tube forming a water flow passage, and a water outlet from said passage:

a main water valve for said passage;

a control handle;

an actuator stem extending from said control handle through said passage to said main water valve, and comprising a hollow vent tube forming a vent passage;

an inner vent hole from said water flow passage into said vent passage, and an outer vent hole from said vent passage to the ambient atmosphere;

a resilient, radially compressible and expandable back pressure seal valve between said vent tube and said water tube to radially compress under forward water flow pressure for water flow through said water flow passage, and to radially expand to prevent backward water flow in said water flow passage;

said seal valve being axially movable a controlled amount between a vent hole-covering position to cover said inner vent hole during forward water flow pressure, and a vent hole-uncovering position to uncover said inner vent hole during back flow pressure and thereby vent said water flow passage of said back pressure to the ambient atmosphere;

said back pressure seal valve having a pair of annular sealing lips around its smallest diameter portion and spaced from each other to seal against said vent tube astraddle said inner vent hole.

11. A wall mountable water sillcock comprising:

a sillcock body having an inner end, an outer end and a water outlet therebetween;

an elongated water tube having a first end at said inner end of said body, and a second end;

a water pipe connection adapter end connected to said water tube second end;

a control handle at said sillcock body outer end;

an elongated vent and valve actuator tube inside said water tube, said tubes defining an annular water flow passage internally of said water tube and externally of said vent tube and said vent tube defining an interior vent passage;

a packing seal between said vent tube and said sillcock body at said outer end of said sillcock body;

said vent and valve actuator tube having an outer end extending through said packing seal and connected to said control handle, and said vent and valve actuator tube having an inner end;

a main water valve at said vent tube inner end, cooperable with said adapter to control water flow through said water tube with operation of said control handle;

an outer vent hole in said vent tube, externally of said packing seal, and positioned to communicate between said vent tube passage and the atmosphere externally of said sillcock;

an inner vent hole positioned to communicate between said vent tube passage and said water flow passage;

a resilient, radially deformable back pressure seal valve adjacent said inner vent hole, separate from said main water valve, and radially collapsible to allow water flow from said main valve through said water flow passage and out said water outlet, and radially expandable to engage and seal said water flow tube against reverse flow, and said deformable valve seal being axially movable under water outflow pressure, relative to said vent tube, from a first position uncovering said inner vent hole to a second position covering said vent hole, and movable under back pressure back to said first position uncovering said vent hole to vent to the atmosphere any back pressure of said water flow passage downstream of said deformable seal valve.

12. The water sillcock in claim 11 wherein said main water valve has a hollow end attached to said vent tube, said seal valve being mounted on and movable axially on said water valve hollow end, and said inner vent hole extends through said water valve hollow end.

13. The water sillcock in claim 11 wherein said seal valve is mounted on and axially movable on said vent tube, and said inner vent hole extends through said vent tube.

14. The water sillcock in claim 11 including a vacuum breaker on said hydrant body.

* * * * *